US010998659B2

(12) United States Patent
Mukuno

(10) Patent No.: US 10,998,659 B2
(45) Date of Patent: May 4, 2021

(54) FEMALE TERMINAL

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventor: Junichi Mukuno, Mie (JP)

(73) Assignees: AutoNetworks Technologies, Ltd.; Sumitomo Wiring Systems, Ltd.; Sumitomo Electric Industries, Ltd.

( * ) Notice: Subject to any disclaimer, the term of this patent is extended or adjusted under 35 U.S.C. 154(b) by 68 days.

(21) Appl. No.: 16/498,553

(22) PCT Filed: Mar. 9, 2018

(86) PCT No.: PCT/JP2018/009215
§ 371 (c)(1),
(2) Date: Sep. 27, 2019

(87) PCT Pub. No.: WO2018/180368
PCT Pub. Date: Oct. 4, 2018

(65) Prior Publication Data

US 2021/0104833 A1 Apr. 8, 2021

(30) Foreign Application Priority Data

Mar. 30, 2017 (JP) ..... JP2017-067266

(51) Int. Cl.
*H01R 13/11* (2006.01)
*H01R 13/187* (2006.01)
*H01R 4/02* (2006.01)

(52) U.S. Cl.
CPC ..... *H01R 13/11* (2013.01); *H01R 13/187* (2013.01); *H01R 4/023* (2013.01); *H01R 13/113* (2013.01)

(58) Field of Classification Search
CPC ..... H01R 13/11; H01R 13/113; H01R 4/023; H01R 13/187
See application file for complete search history.

(56) References Cited

U.S. PATENT DOCUMENTS 5,222,811 A * 6/1993 Miyoshi ..... G01K 7/16 374/208
5,785,555 A * 7/1998 O'Sullivan ..... H01R 13/65918 439/579

(Continued)

FOREIGN PATENT DOCUMENTS

JP 3415141 6/2003
JP 2011-249169 12/2011

(Continued)

OTHER PUBLICATIONS

International Search Report dated Apr. 17, 2018.

*Primary Examiner* — Tho D Ta
(74) *Attorney, Agent, or Firm* — Gerald E. Hespos; Michael J. Porco; Matthew T. Hespos

(57) ABSTRACT

A female terminal 10 to be fit to a male terminal 60 and connected to a wire 40 includes a box-shaped female body portion 12 open in a front-rear direction, the male terminal 60 being inserted into the female body portion, a contact pressure applying portion 16 configured to apply a contact pressure to the male terminal 60 inwardly of the female body portion 12 from a ceiling wall 14 of the female body portion 12, and bottom wall contact portions 26 projecting from a bottom wall 24 of the female body portion 12 and configured to contact the male terminal 60. A conductor portion of the wire 40 is mounted by welding on a back surface 28 opposite to a surface where the bottom wall 24 and the male terminal 60 are in contact.

6 Claims, 6 Drawing Sheets

(56) References Cited

U.S. PATENT DOCUMENTS

| | | | | |
|---|---|---|---|---|
| 5,961,348 | A * | 10/1999 | Murphy | H01R 9/05 439/579 |
| 2006/0009090 | A1* | 1/2006 | Noro | H01R 13/113 439/851 |
| 2009/0249609 | A1* | 10/2009 | Heacox | H01R 43/16 29/592.1 |
| 2011/0198122 | A1 | 8/2011 | Sagawa et al. | |
| 2011/0294366 | A1 | 12/2011 | Iihoshi | |
| 2015/0171546 | A1* | 6/2015 | Kibushi | H01R 13/114 439/382 |

FOREIGN PATENT DOCUMENTS

| | | |
|---|---|---|
| JP | 2013-51136 | 3/2013 |
| JP | 5660458 | 1/2015 |
| WO | 2014/077144 | 5/2014 |

* cited by examiner

FEMALE TERMINAL

BACKGROUND

Field of the Invention

This specification relates to a female terminal.

Related Art

Publication of Japanese Patent No. 3415141 discloses a female terminal fitting with a substantially box-shaped female body that is open in a front-rear direction and a barrel that is crimpable into connection with an end of a wire in the front-rear direction. A resilient contact piece is provided inside the female body and is configured to contact a pin-like male terminal fitting.

The male terminal fitting is inserted into the female body of the female terminal fitting and resiliently contacts the resilient contact piece of the female terminal fitting so that the male terminal fitting and the female terminal fitting become electrically conductive. In this way, a contact resistance is generated at a male terminal contact portion where the male terminal fitting and the female terminal fitting are in contact. Further, the barrel is crimped and connected to a core of the wire so that the female terminal fitting and the wire become electrically conductive. In this way, a contact resistance is generated at a core contact portion where the barrel and the core are in contact. Furthermore, a conductor resistance of the female terminal fitting is generated between the male terminal contact portion and the core contact portion. Thus, if the female terminal fitting is energized, the female terminal fitting generates heat due to these resistances.

As a current flowing into the female terminal fitting increases, the amount of heat generation of the female terminal fitting increases and the conductor resistance of the female terminal fitting also increases in proportion to the amount of heat generation of the female terminal fitting. Thus, heat generation of the female terminal fitting needs to be suppressed in a device in which a large current flows. Generally, a conductor resistance of a female terminal fitting is reduced by increasing a plate thickness of the female terminal fitting to suppress heat generation. However, a thicker plate disadvantageously increases processing cost, material cost and weight of the female terminal fitting

SUMMARY

A female terminal disclosed in this specification is to be fit to a male terminal and connected to a wire. The female terminal includes a box-shaped female body that is open in a front-rear direction so that the male terminal can be inserted into the female body. The female terminal further includes a contact pressure applying portion configured to apply a contact pressure to the male terminal inwardly of the female body from a ceiling wall of the female body, and a bottom wall contact projecting from a bottom wall of the female body and configured to contact the male terminal. A conductor of the wire is mounted by welding on a back surface opposite to a surface where the bottom wall and the male terminal are in contact.

A length from the contact portion between the male terminal and the female terminal to the contact portion between the female terminal and the wire is substantially equal to a plate thickness of the bottom wall. Thus, when the female terminal is energized, heat generation due to a conductor resistance of the female terminal can be suppressed. Further, heat generated due to a contact resistance generated at the contact portion between the male terminal and the female terminal easily can be radiated to the conductor portion of the wire.

The female terminal may include a first positioning plate projecting down from a front end part of the bottom wall, a rear plate projecting rearward from a rear end part of the bottom wall, and two second positioning plates projecting down from both sides of the rear plate. The first positioning plate and the two second positioning plates provided in the female terminal exhibit a positioning function, for example, when the female terminal is inserted into a female connector housing since three plates come into contact with a front wall, side walls and a bottom wall inside the female connector housing.

The contact pressure applying portion may extend forward from a rear end of the ceiling wall toward a front end of the female body portion and may project inward of the female body from the ceiling wall. Additionally, the contact pressure applying portion may include plural resilient contact pieces arranged in a direction intersecting an inserting direction of the male terminal into the female body portion. With this configuration, the resilient contact pieces are integrated with the female terminal. Thus, processing cost can be reduced as compared to the case where the resilient contact pieces and the female terminal are separate.

The contact pressure applying portion may be separate from the female body. Thus, a contact pressure with the male terminal easily can be changed by changing a material and a plate thickness of the contact pressure applying portion.

According to the female terminal disclosed in this specification, the heat generation of the female terminal can be suppressed without increasing the plate thickness of the female terminal.

DETAILED DESCRIPTION

A first embodiment is described with reference to FIGS. 1 to 5.

Figure 5:
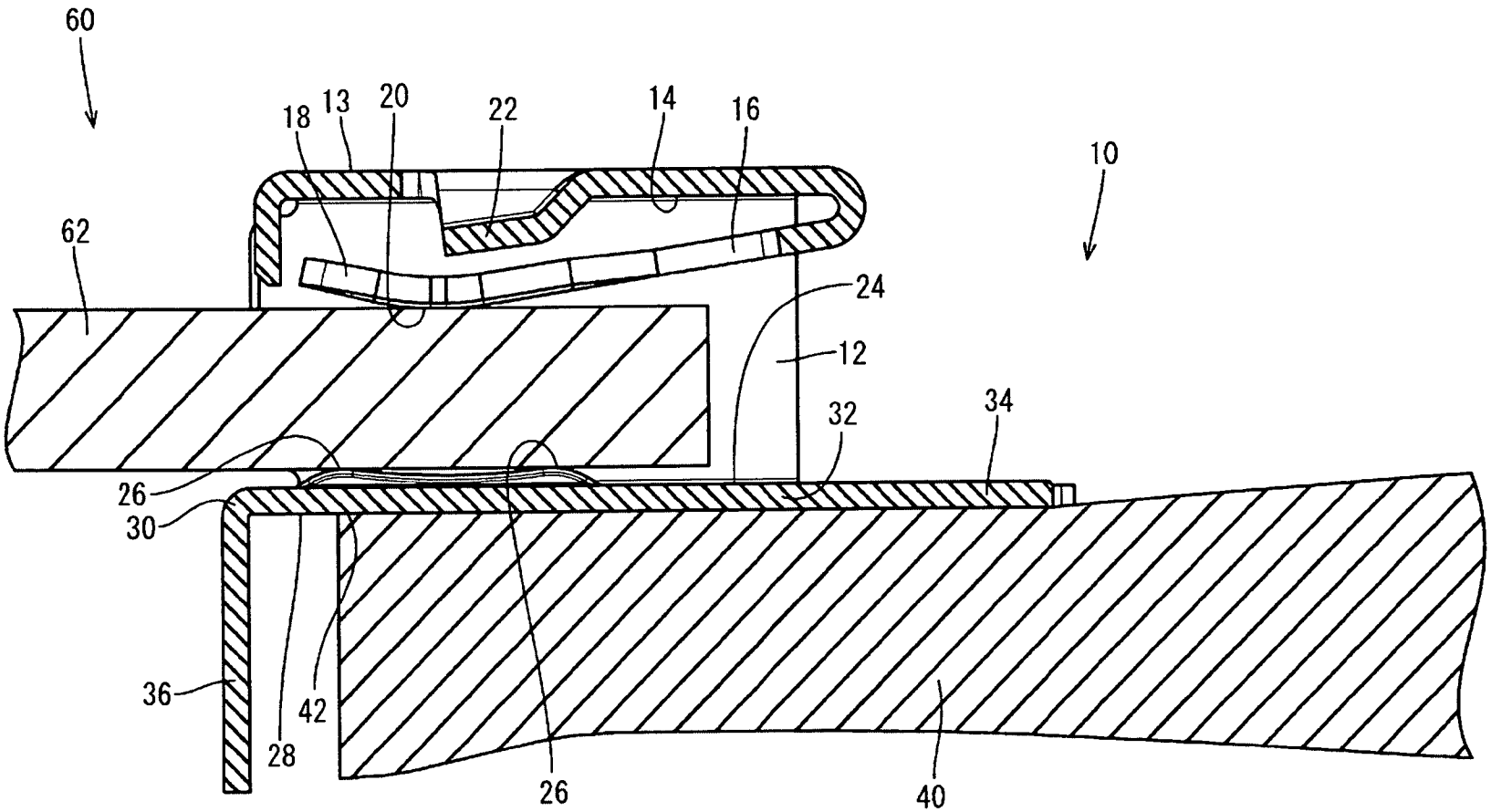
FIG. 5 is a section along A-A after a male terminal and the female terminal are fit.

A female terminal 10 of this embodiment is, for example, used to connect an inverter and a motor in a hybrid or electric vehicle. The female terminal 10 is formed by stamping and bending a copper plate having a thickness of about 0.6 mm. The female terminal 10 is inserted into an unillustrated female connector housing. As shown in FIG. 5, the female terminal 10 includes a box-shaped female body 12 and a braided wire 40 attached to a bottom wall back surface 28, which is a surface opposite to the upper surface (surface to be held in contact with a male body 62 to be described later) of a bottom wall 24 of the female body 12. Further, the female terminal 10 includes a first positioning plate 36 and two second positioning plates 38 that exhibit a positioning function when inserting the female terminal 10 into the unillustrated female connector housing. On the other hand, a male terminal 60 to be fit to the female terminal 10 includes a plate-like male body 62. The male terminal 60 is inserted into an unillustrated male connector housing. In the following description, a fitting direction to the male terminal 60 is referred to as a forward direction, and a direction from the bottom wall 24 toward a ceiling wall 14 of the female terminal 10 is referred to as an upward direction.

The box-shaped female body 12 is open in a front-rear direction. The ceiling wall 14 located on an upper inner side of the female body 12 is provided with a contact pressure applying portion 16 for applying a contact pressure to the male body portion 62.

Figure 1:
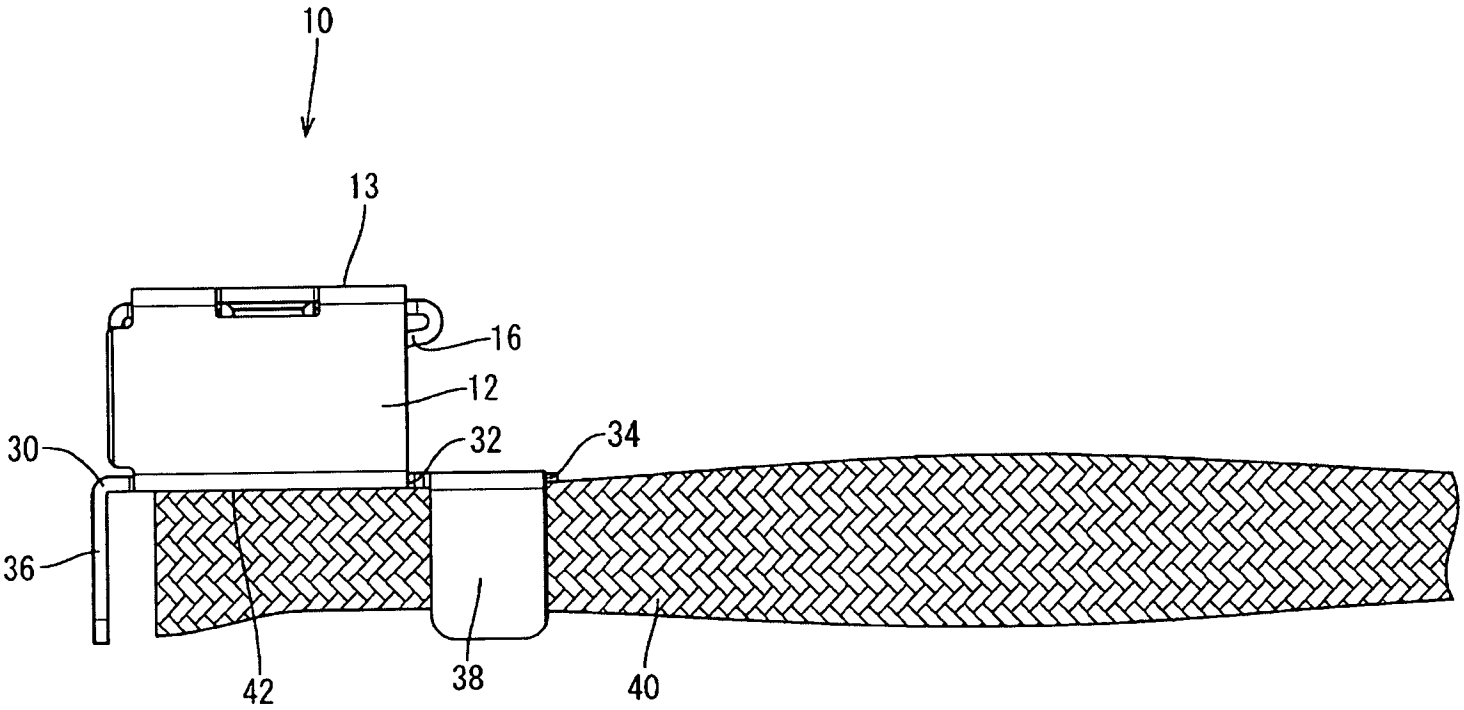
FIG. 1 is a front view of a female terminal in a first embodiment.
Figure 2:
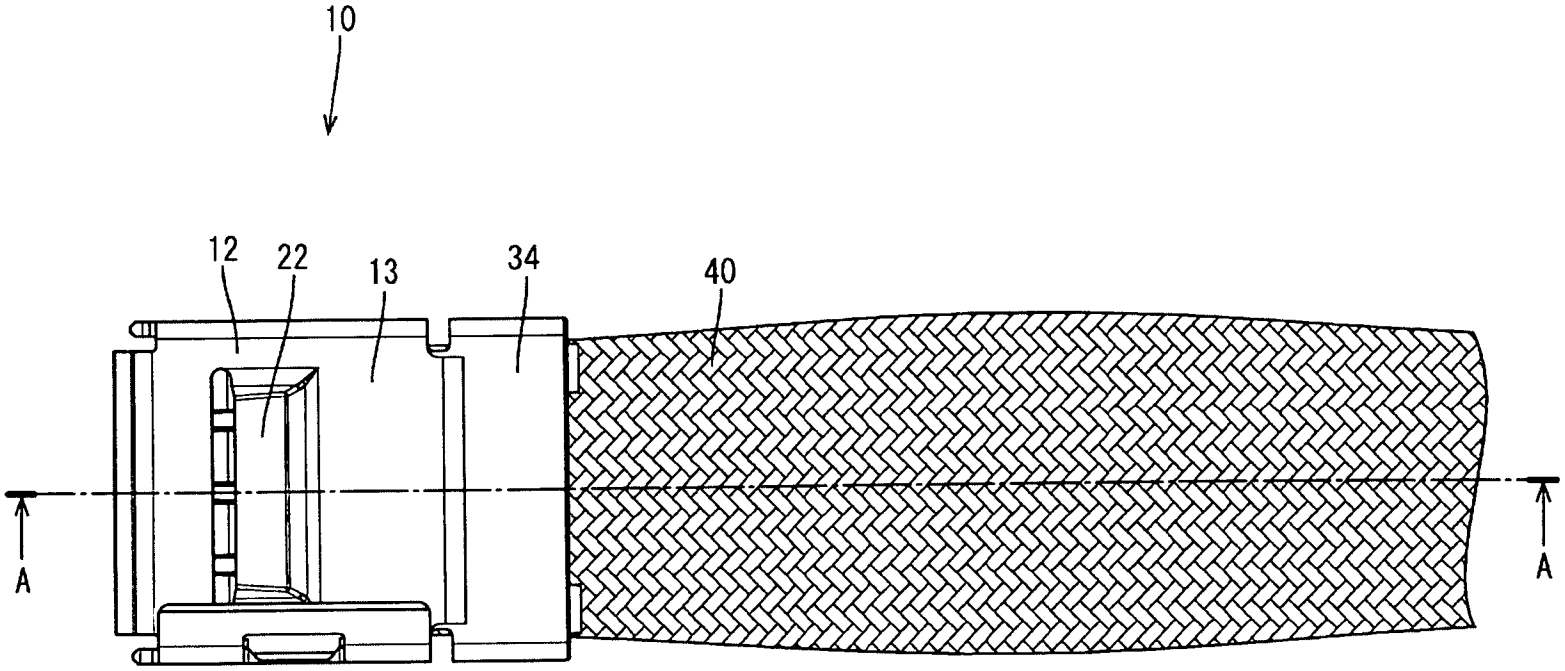
FIG. 2 is a plan view of the female terminal.
Figure 3:
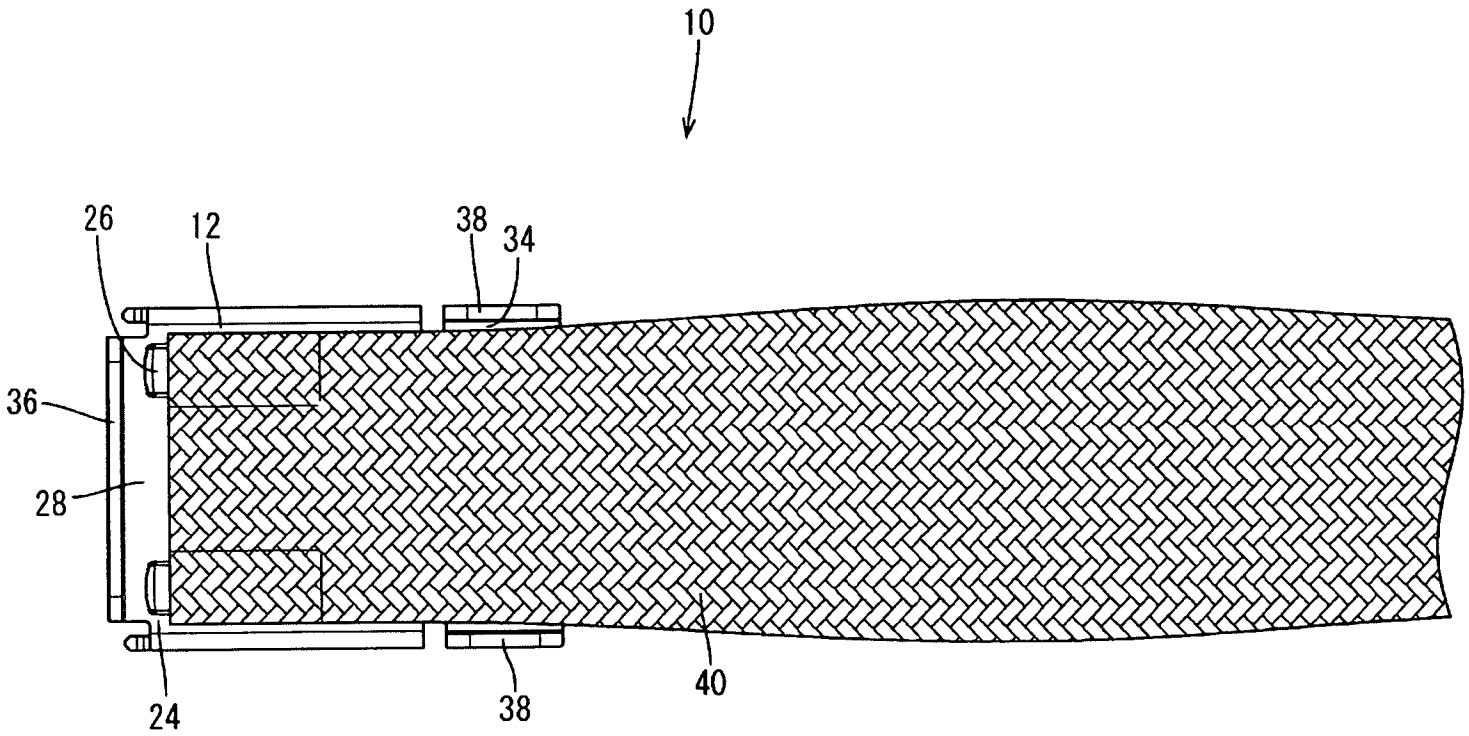
FIG. 3 is a back view of the female terminal.
Figure 4:
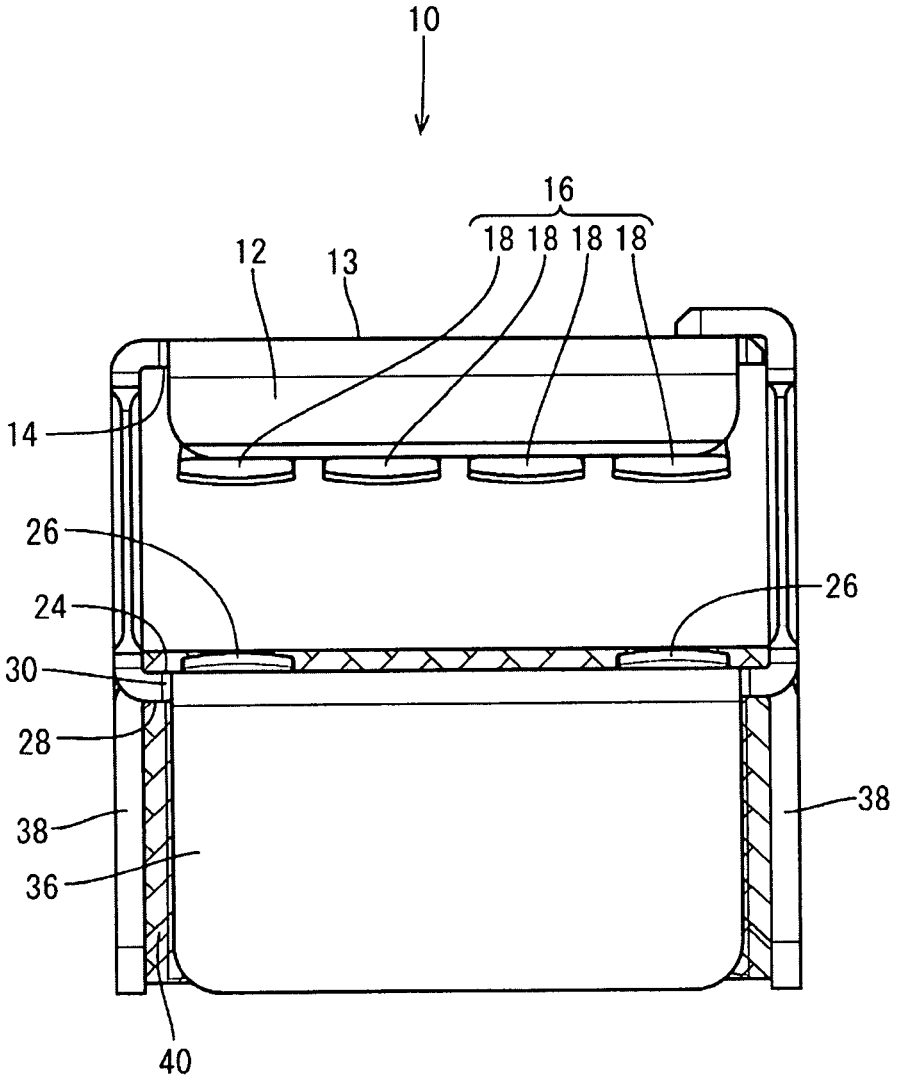
FIG. 4 is a left side view of the female terminal.

The contact pressure applying portion 16 extends forward from a rear end of the ceiling wall 14 toward a front end of the female body 12. Further, as shown in FIG. 4, the contact pressure applying portion 16 is composed of four resilient contact pieces 18 provided at equal intervals in a direction intersecting an inserting direction of the male terminal 60 into the female body 12.

An excessive deflection preventing portion 22 is provided near a center of the ceiling wall 14 of the female body 12. The excessive deflection preventing portion 22 is formed by cutting a part of the ceiling wall 14 to form a cut piece and pressing the cut piece inward from above the female body 12. If the male terminal 60 is inserted into the female body 12 and the male body 62 and the resilient contact pieces 18 resiliently contact, the resilient contact pieces 18 are pressed to move upward. If the resilient contact pieces 18 move more than a certain amount, the resilient contact pieces 18 contact the excessive deflection preventing portion 22 and cannot move any farther up. In this way, the resilient contact pieces 18 are prevented from being deformed plastically due to excessive deflection.

The bottom wall 24 of the female body 12 is provided with bottom wall contact portions 26 configured to contact the male body 62. As shown in FIG. 4, the bottom wall contact portions 26 are in the form of beads projecting upward from the bottom wall 24 at positions corresponding to the resilient contact pieces 18 on both ends, out of the four resilient contact pieces 18. Further, each bottom wall contact portion 26 is formed with two projections spaced apart in the front-rear direction. Tops of the respective projections serve as contact points with the male body 62.

The plate-like first positioning plate 36 projects down from a bottom wall front end 30. Further, a rear plate 34 projects rearward from a bottom wall rear end 32. The second positioning plates 38 project down from both sides of the rear plate 34.

A conductor portion of the braided wire 40 is connected to the bottom wall back surface 28 of the female terminal 10 by resistance welding. In this way, the female terminal 10 and the braided wire 40 become electrically conductive via a conductor contact portion 42 between the bottom wall back surface 28 and the braided wire 40.

Next, functions of this embodiment are described.

The female terminal 10 can be inserted into the female connector housing so that the two second positioning plates 38 of the female terminal 10 contact side walls inside the female connector housing. Further, the first positioning plate 36 and the two second positioning plates 38 of the female terminal 10 contact a bottom wall inside the female connector housing. Furthermore, the first positioning plate 36 of the female terminal 10 contacts a front wall provided inside the female connector housing so that the female terminal 10 is stopped in front. In this way, the position of the female terminal 10 in the female connector housing is determined.

If the male connector housing and the female connector housing are connected, the resilient contact pieces 18 of the female terminal 10 are pressed resiliently against the male body 62 of the male terminal 60, as shown in FIG. 5. In this way, the male body 62 and the resilient contact pieces 18 resiliently contact via contact piece contact portions 20. Further, the male body 62 is pressed against the bottom wall 24 of the female terminal 10 by being resiliently pressed by the resilient contact pieces 18. In this way, the male body portion 62 and the bottom wall 24 of the female terminal 10 contact via the bottom wall contact portions 26. A combined resistance R between the contact portions of the male terminal 60 and the female terminal 10 and the conductor contact portion 42 is expressed as follows using resistances R1 and R2.

$$\text{Resistance } R=(R1//R2)+\text{contact resistance of conductor contact portion 42}$$

Resistance R1=contact resistance of contact piece contact portions 20+conductor resistance Rc1 between contact piece contact portions 20 and conductor contact portion 42

Resistance R2=contact resistance of bottom wall contact portions 26+conductor resistance Rc2 between bottom wall contact portions 26 and conductor contact portion 42

The resistance R generates heat if the female terminal 10 is energized.

Generally, a conductor resistance is inversely proportional to a conductor cross-sectional area and is proportional to a conductor length. The conductor length that determines the conductor resistance Rc2 is a length from the bottom wall contact portions 26 to the conductor contact portion 42 and is substantially equal to the plate thickness of 0.6 mm of the female terminal 10. Further, the conductor cross-sectional area determining the conductor resistance Rc2 is an area of the bottom wall 24. A cross-sectional area determining the conductor resistance Rc1 differs depending on a location, but a cross-sectional area of the contact pressure applying portion 16 is smaller than the area of the bottom wall 24. Further, since a length of the contact pressure applying portion 16 is longer than the plate thickness of the female terminal 10, the conductor resistance Rc1 is larger than the conductor resistance Rc2. Thus, a current flowing from the bottom wall contact portions 26 to the conductor contact portion 42 is larger than a current flowing from the contact piece contact portions 20 to the conductor contact portion 42. Therefore heat generation due to the conductor resistance Rc2 between the bottom wall contact portions 26 and the conductor contact portion 42 is problematic. However, as described above, the conductor length determining the conductor resistance Rc2 is a length equivalent to the plate thickness of 0.6 mm of the female terminal 10 and the conductor cross-sectional area is the area of the bottom wall 24. Thus, the heat generation due to the conductor resistance Rc2 can be suppressed. As just described, the plate thickness of the female terminal needs to be increased to lower the conductor resistance in the conventional female terminal, but the conductor resistance Rc2 can be reduced as the plate thickness is reduced in the female terminal 10. Further, heat is generated due to the contact resistance of the bottom wall contact portions 26 serving as contact points between the male terminal 60 and the female terminal 10, but the generated heat is transferred to a conductor portion in a rear part of the braided wire 40 connected to the bottom wall back surface 28 through the bottom wall 24 having a plate thickness of 0.6 mm. Thus, heat generation due to the contact resistance of the bottom wall contact portions 26 can be suppressed. Similarly, heat is generated due to the contact resistance of the conductor contact portion 42, but the generated heat is transferred to the conductor in the rear part of the braided wire 40. Thus, heat generation due to the contact resistance of the conductor contact portion 42 also can be suppressed. In the above way, the heat generation of the female terminal 10 can be suppressed.

As described above, according to this embodiment, the length from the contact portions 26 between the male and female terminals 60 and 10 to the conductor contact portion 42 between the female terminal 10 and the braided wire 40 is substantially equal to the plate thickness of the bottom wall 24. Thus, when the female terminal 10 is energized, heat generated due to the conductor resistance of the female terminal 10 can be suppressed. Further, a distance from the contact portions between the male and female terminals 60 and 10 to the conductor contact portion 42 between the female terminal 10 and the braided wire 40 is equal to the plate thickness of the bottom wall 24. Thus, heat generated due to the contact resistance generated at the contact portions between the male terminal and the female terminal easily is radiated to the conductor portion of the braided wire 40.

Further, the first positioning plate 36 and the two second positioning plates 38 provided in the female terminal 10 exhibit the positioning function, for example, when the female terminal 10 is inserted into the unillustrated female connector housing.

Further, since the contact pressure applying portion 16 is integrated with the female terminal 10, processing cost can be reduced as compared to the case where these are separate.

Figure 6:
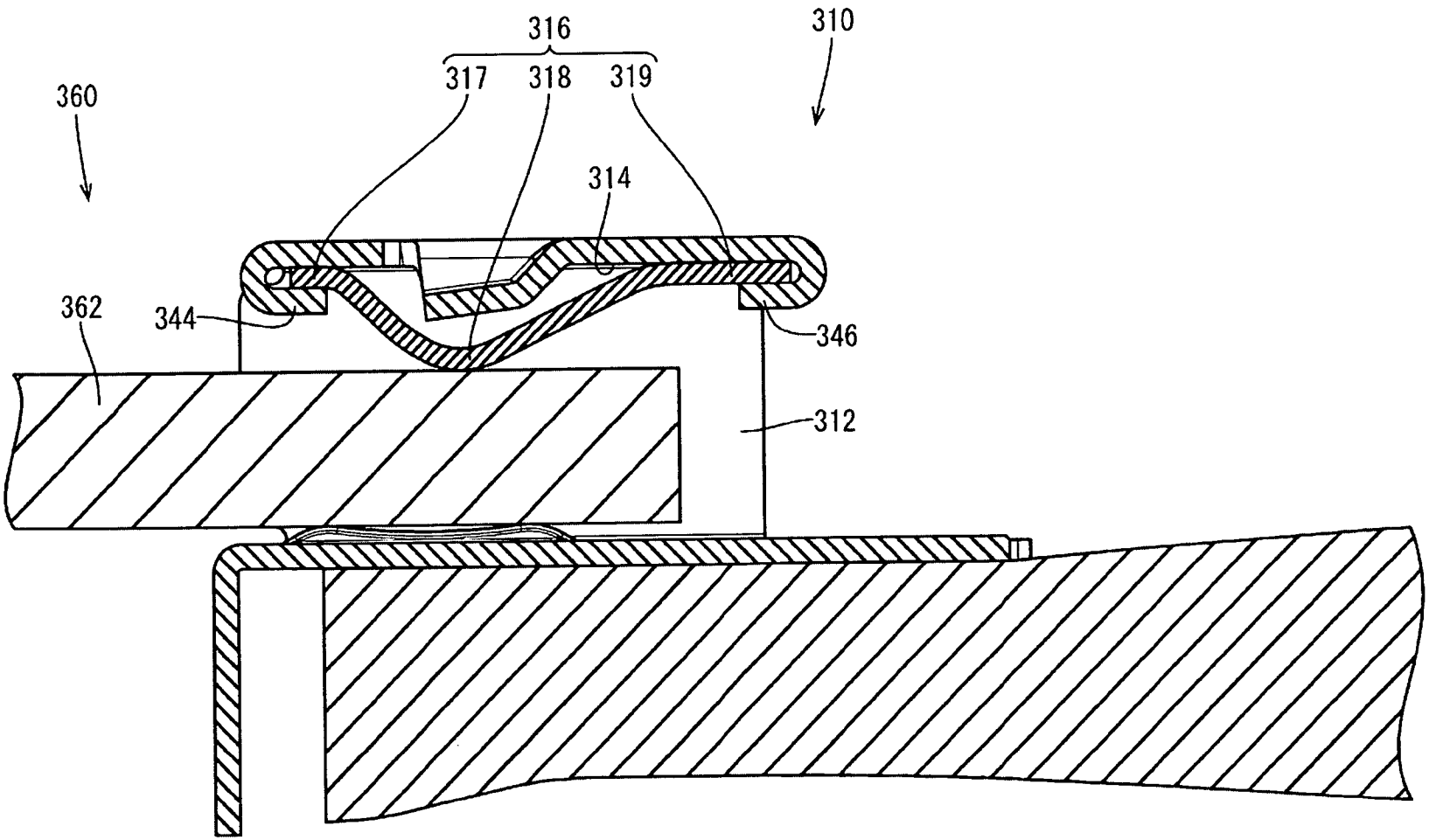
FIG. 6 is a section in a second embodiment.

Next, a second embodiment in which the structure of a contact pressure applying portion is changed is described with reference to FIG. 6.

Although the female body 12 and the contact pressure applying portion 16 are integrated in the first embodiment, a female body 312 and a contact pressure applying portion 316 are separate in a female terminal 310 of this second embodiment. The contact pressure applying portion 316 is formed by stamping and bending a stainless steel plate having a thickness of about 0.5 mm.

A ceiling wall 314 of the female body 312 includes a front holding portion 344 and a rear holding portion 346. The front holding portion 344 is formed by bending a front part of the ceiling wall 314 inwardly of the female body 312, and the rear end holding portion 346 is formed by bending a rear part of the ceiling wall 314 inwardly of the female body 312.

The contact pressure applying portion 316 includes front holding plate 317 and rear holding plate 319 and a concave spring 318 between the front holding plate 317 and the rear holding plate 319. The front holding plate 317 of the contact pressure applying portion 316 is accommodated inside the front holding portion 344, and the rear holding plate 319 is accommodated inside the rear holding portion 346. In this way, the contact pressure applying portion 316 is held in the female body 312. Although not shown, three slits are formed at equal intervals in a direction intersecting an inserting direction of a male body 362 of a male terminal 360 to be fit in the spring 318 of the contact pressure applying portion 316. This causes the male body 312 and the spring 318 to resiliently contact via four contact points if the male body 362 is inserted into the female body 312.

Other parts are similar as in the first embodiment and, hence, not described.

As described above, since the contact pressure applying portion 316 is a separate component according to this embodiment, a contact pressure with the male terminal 360 can be changed easily by changing a material and a plate thickness of the contact pressure applying portion 316.

The invention is not limited to the above described and illustrated embodiments. For example, the following various modes also are included.

Although the copper plate having a plate thickness of about 0.6 mm is used as a base material of the female body portion 12 in the above first embodiment, the thickness and material of the plate do not matter.

Although the stainless steel plate having a plate thickness of about 0.5 mm is used as a base material of the contact pressure applying portion 316 in the above second embodiment, the thickness and material of the plate do not matter.

Although there are four resilient contact pieces 18 in the above first embodiment, the number of the resilient contact pieces 18 does not matter.

Although the braided wire 40 is used as a wire to be connected to the female terminal 10 in the above first embodiment, any wire may be used. For example, a coated wire in which a core is coated by a coating made of an insulating material may be used.

Although the bottom wall contact portions 26 are in the form of beams projecting upward from the bottom wall 24 in the above first embodiment, the shape of the bottom wall contact portions 26 does not matter. For example, the bottom wall contact portions 26 may have an embossed shape.

Although the braided wire 40 is resistance-welded to the female body portion 12 in the above first embodiment, any welding method may be used. For example, welding may be performed by ultrasonic welding, laser welding, electron beam welding or the like.

LIST OF REFERENCE SIGNS

10 . . . female terminal
12 . . . female body portion
14 . . . ceiling wall
16 . . . contact pressure applying portion
18 . . . resilient contact piece
20 . . . contact piece contact portion
22 . . . excessive deflection preventing portion
24 . . . bottom wall
26 . . . bottom wall contact portion
28 . . . bottom wall back surface
30 . . . bottom wall front end part
32 . . . bottom wall rear end part
34 . . . rear plate
36 . . . first positioning plate
38 . . . second positioning plate
40 . . . braided wire (wire)
42 . . . conductor contact portion
60 . . . male terminal
62 . . . male body
310 . . . female terminal
312 . . . female body
314 . . . ceiling wall
316 . . . contact pressure applying portion
317 . . . front holding plate
318 . . . spring
319 . . . rear end holding plate
344 . . . front end holding portion
346 . . . rear end holding portion
360 . . . male terminal
362 . . . male body

The invention claimed is:

1. A female terminal to be fit to a male terminal and connected to a wire, comprising:

a box-shaped female body open in a front-rear direction, the male terminal being inserted into the female body;

a contact pressure applying portion configured to apply a contact pressure to the male terminal inwardly of the female body from a ceiling wall of the female body; and a bottom wall contact portion projecting from a bottom wall of the female body and configured to contact the male terminal;

a conductor portion of the wire being mounted by welding at a position facing the bottom wall contact portion on a back surface opposite to a surface where the bottom wall and the male terminal are in contact.

2. The female terminal of claim 1, comprising:

a first positioning plate projecting down from a front part of the bottom wall;

a rear plate projecting rearward from a rear part of the bottom wall; and two second positioning plates projecting down from both side of the rear plate.

3. The female terminal of claim 2, wherein the contact pressure applying portion extends forward from a rear part of the ceiling wall toward a front part of the female body, projects inwardly of the female body from the ceiling wall and includes a plurality of resilient contact pieces arranged in a direction intersecting an inserting direction of the male terminal into the female body.

4. The female terminal of claim 2, wherein the contact pressure applying portion is separate from the female body.

5. The female terminal of claim 1, wherein the contact pressure applying portion extends forward from a rear part of the ceiling wall toward a front part of the female body, projects inwardly of the female body from the ceiling wall and includes a plurality of resilient contact pieces arranged in a direction intersecting an inserting direction of the male terminal into the female body.

6. The female terminal of claim 1, wherein the contact pressure applying portion is separate from the female body.

* * * * *